US005542604A

United States Patent [19]

Ferren

[11] Patent Number: 5,542,604

[45] Date of Patent: Aug. 6, 1996

[54] DRINKING FOUNTAIN WITH SOUND EFFECTS

[75] Inventor: Bran Ferren, East Hampton, N.Y.

[73] Assignee: The Walt Disney Company, Burbank, Calif.

[21] Appl. No.: 350,799

[22] Filed: Dec. 7, 1994

[51] Int. Cl.[6] ..... E03B 9/04

[52] U.S. Cl. ..... 239/29; 239/289

[58] Field of Search ..... 239/23, 18–22, 239/72, 284

[56] References Cited

U.S. PATENT DOCUMENTS

| | | | |
|---|---|---|---|
| 1,090,876 | 3/1914 | Pollard | 239/29 |
| 3,585,991 | 6/1971 | Balamuth . | |
| 4,156,432 | 5/1979 | Helwig, Jr. . | |
| 4,269,352 | 5/1981 | Przystawik | 239/23 X |
| 4,305,117 | 12/1981 | Evans | 362/96 |
| 4,749,126 | 6/1988 | Kessener et al. . | |
| 4,858,826 | 8/1989 | Robinson et al. | 239/18 |
| 4,898,060 | 2/1990 | To | 84/95.2 |
| 4,901,922 | 2/1990 | Kessener et al. . | |
| 4,905,897 | 3/1990 | Rogers et al. | 239/72 X |
| 4,936,508 | 6/1990 | Ingalz . | |

*Primary Examiner*—Kevin P. Weldon

*Attorney, Agent, or Firm*—Pretty, Schroeder, Brueggemann & Clark

[57] ABSTRACT

A drinking fountain having a spout, a human actuatable valve for controlling the flow of water from the spout, a basin for collecting the water and a drain pipe. An audio system includes a speaker wherein the speaker is mounted to the drain pipe in such a manner as to direct soundwaves into the drain pipe. The audio system is responsive to actuation of the valves such that it plays an audible sound from the speaker in response to the actuation. The audio system may include a sequential sound source having a plurality of sound clips that are playable in response to respective actuations of the valve.

20 Claims, 2 Drawing Sheets

FIG. 1
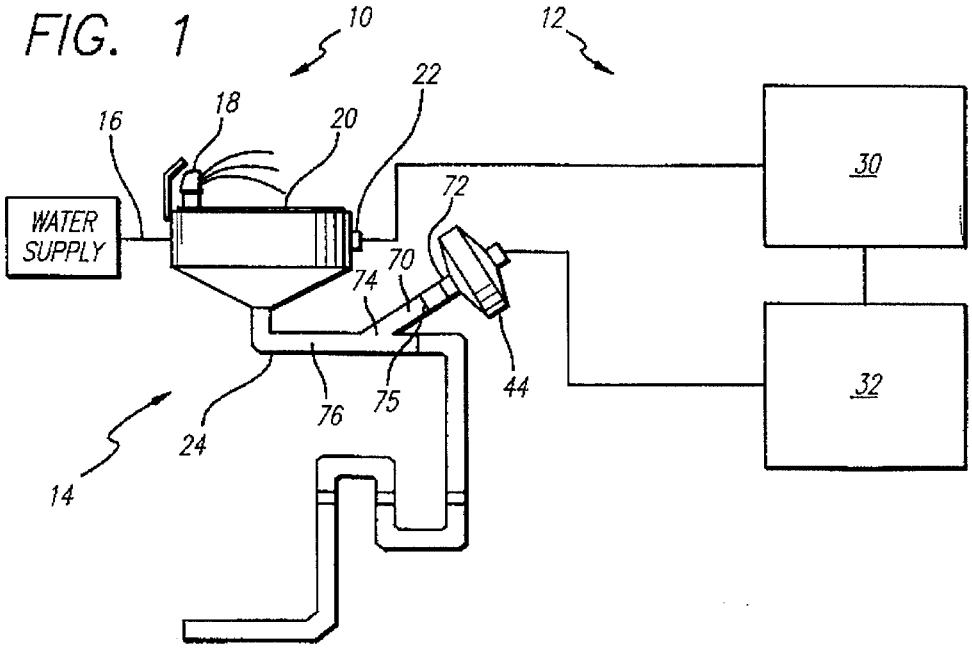
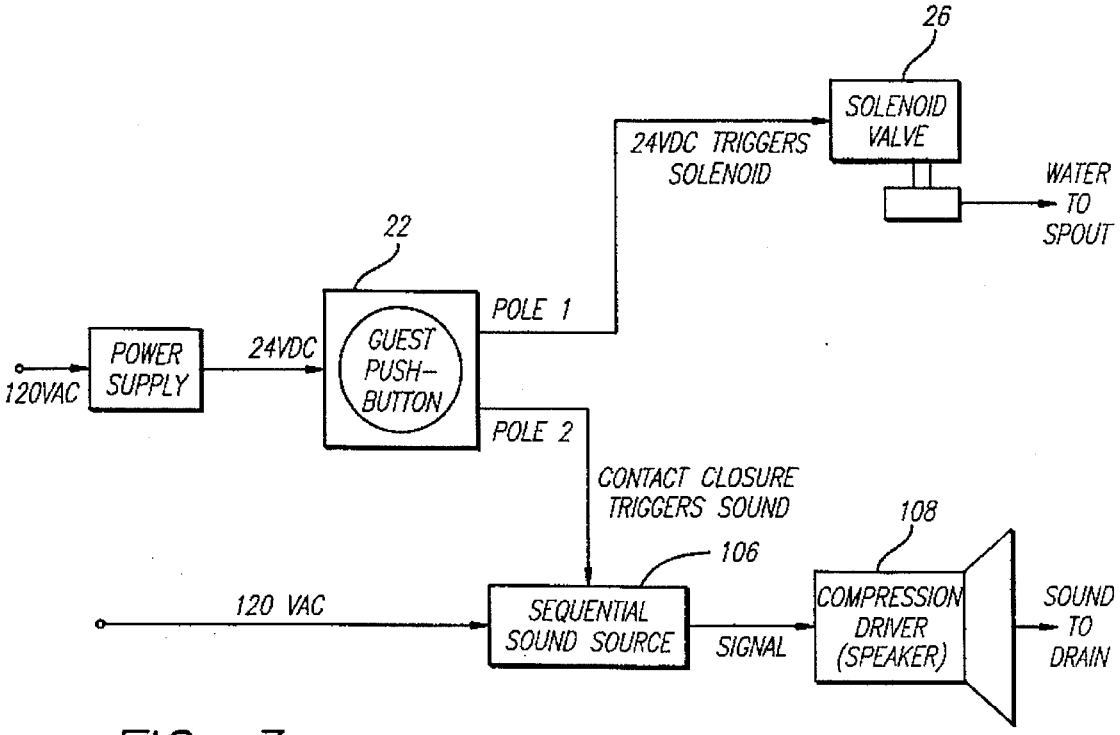
FIG. 3

DRINKING FOUNTAIN WITH SOUND EFFECTS

This invention relates to fountains, faucets and other fixtures that supply water or other liquids and, in particular, to such fixtures that are provided with special effects.

BACKGROUND OF THE INVENTION

Amusement parks and theme parks provide a variety of rides and shows for the amusement and entertainment of their patrons. Some patrons visit the parks for the exhilarating rides, others come to view the special effects associated with the shows. Many simply appreciate the pleasurable diversions they encounter during their visit.

To make their patrons' visits more comfortable, the parks provide drinking fountains, restrooms and other facilities on the park grounds. These facilities, however, typically are not part of the show and do not incorporate the special effects that are associated with other features in the park. It should be appreciated, therefore, that adding special effects to drinking fountains and the like, would serve as another source of entertainment and novelty to the patrons.

Lighting effects have been previously known in connection with fountains and water faucets. See, e.g., U.S. Pat. Nos. 4,749,126 and 4,901,922 to Kessener et al. In these patents, a light is introduced into the fluid stream and may be controlled to provide various visual effects. The latter patent also describes the use of a piezoelectric device for producing sound waves in the sonic or ultrasonic region. The sound waves are created, however, for the purpose of producing vibrations in the liquid medium, resulting in a particular visual effect. Neither of these patents discloses a fountain, faucet or other fixture having audible sounds that are intended to be heard by the patron.

From the above, it will be appreciated that there is still a need for a drinking fountain, faucet or other fixture that incorporates sound effects with the use of the fixture. The present invention satisfies this need.

SUMMARY OF THE INVENTION

The present invention is embodied in a fountain, faucet or other fixture that has associated therewith a sound system that plays audible sound upon operation of the fixture by a patron. For example, in one preferred embodiment, a guest depresses a push button on a drinking fountain to get a drink of water. A sound effect can occur at the instant that the button is depressed, after an electronically timed delay, when the button is released or when triggered by some other event or sensor (e.g., a motion detector). Possible sound effects include gurgling, a voice saying "ahhhh", or any number of other sounds, sound effects, or music.

The fixture of the present invention includes a spout for delivering pressurized fluid, a human actuatable valve for controlling the delivery of the pressurized fluid from the spout, and an audio system having a speaker. A feature of the invention is that the speaker may be acoustically coupled to a drain pipe of the fixture such that the sound emanates from the drain. An acoustic pipe having the speaker mounted at one end thereof may be connected to the drain pipe in such a way as to provide a sound passage from the speaker through the acoustic pipe into the drain pipe, while minimizing the possibility of drain water entering the speaker.

A further feature of the present invention is that an audio system may be used that is responsive to actuation of the valve such that it plays an audible sound from the speaker in response to the actuation. In addition, the audio system may include a prepared sound clip that is played back in response to a preselected mode of actuation of the valve. For example, the sound clip may be triggered when the valve is turned on by a patron or, alternatively, when the valve is turned off. Also, the sound clip may be triggered at any predetermined time after the valve is actuated.

Another feature of the present invention is that the audio system may include many prepared sound clips in sequence such that each time the valve is actuated a different sound clip is played. This provides an additional element of surprise and novelty to those who return at a later time to use the fountain, faucet or fixture.

Other features and advantages of the present invention will become apparent from the following description of the preferred embodiments, taken in conjunction with the accompanying drawings, which illustrate, by way of example, the principles of the invention.

BRIEF DESCRIPTION OF THE DRAWINGS

FIG. 1 is a schematic drawing of a drinking fountain combined with a sound effects system;

FIG. 3 is a functional block diagram of a simplified drinking fountain and sound effects system.

DETAILED DESCRIPTION OF THE PREFERRED EMBODIMENT

Figure 2:
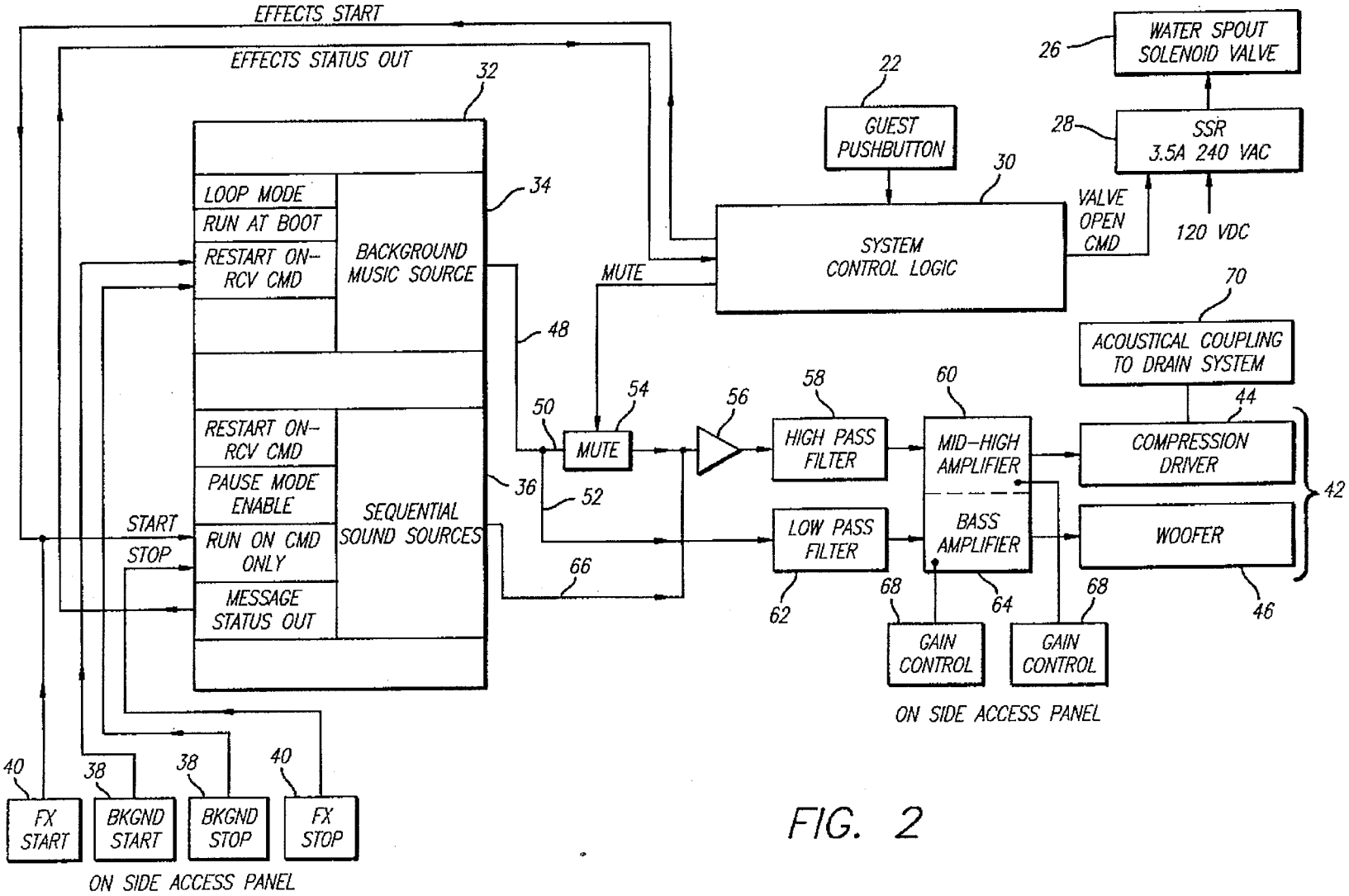
FIG. 2 is a functional block diagram of the drinking fountain and sound effects system of FIG. 1.

A fixture 10 combined with a sound effects system 12 is shown schematically in FIG. 1. In the preferred embodiment, the fixture is a conventional drinking fountain 14 having a water supply line 16, a spout 18, a basin 20, a push button 22 and a drain line 24. Upon actuating the push button 22, a valve 26 is activated (see FIGS. 2 and 3), permitting water to flow from the spout 18. While the button is depressed, a patron may take a drink, fill a container, permit others to drink, etc. When done, the button is released and the valve shuts off the water supply to the spout. The basin 20 collects the unconsumed water and directs it to the drain line 24. In one embodiment (FIG. 2), the valve is actuated by a solid state relay 28. A conventional solid state or relay based control system 30 may be used to trigger the solid state relay when the button 22 is pressed. In a simplified embodiment (FIG. 3), the push button 22 is depressed to close a contact, pole 1, which completes an electrical circuit to trigger the valve 26.

Although a drinking fountain is described in the preferred embodiment, it will be appreciated that the sound effects system to be described below may be used with other fixtures, such as a faucet for a sink or tub, a sewer drain, a hose or other types of fountains. Also, actuating devices for actuating the valve, other than a push button, may be used with the present invention. For example, there are a variety of valve types known to those in the art for turning a faucet on and off. Additionally, motion detection systems or other similar systems may be used, which do not require the patron to actually contact the fixture to actuate the valve.

With reference to FIGS. 1 and 2, the sound effects system 12 includes the control system 30 and an audio system 32. The audio system 32 includes an electronic solid state analog or digital audio storage/playback unit. One preferred system is commercially available from the company "360 Systems" of Tarzana, Calif. under the name "Quadfile." The audio system may be powered by a VDE-Grade power transformer (not shown) that provides a power supply for low voltage items, e.g., 13.5 VDC 7A/10A PK.

In one preferred embodiment, the audio system 32 has at least two separate sound sources, a background sound source 34 and a sequential sound source 36. The background sound source may continuously run a musical piece, such as from a tape or disk or preferably EPROM chips. For example, ten 4 MEG EPROMS may be used to play a musical piece loop that lasts up to 6 minutes at 10 KHZ BW or that lasts up to 4 minutes at 15 KHZ BW. The sequential sound source runs a series of sound effects clips and may similarly be a device such as a tape, disk or EPROM chips. Each sound effects clip may have one of a variety of sounds, such as human sounds (gurgling, gulping, gargling), spoken words ("That's cold"), music clips, special effects sounds or any other audible effect desired.

Typical commercial audio systems provide many desirable options for controlling the sound sources. For example, the background sound source may be operated in a loop mode, which runs the tape, disk or EPROM chips continuously until desired otherwise. A "run at boot" command may also be operated to start the musical piece for the background sound source when the audio system is turned on. Another option would restart the background sound source music piece when the push button for the fixture is actuated ("restart on RCV CMD"). Manual controls 38 are provided for turning the background sound source on and off.

With regard to the sequential sound source, a "pause" mode may be used wherein each of the sound effects clips are separated from one another by a pause command, such that upon receiving a start signal, one sound effects clip is played. The pause command then prevents further clips from being played until another start signal is received. The sound effects clips may be arranged such that the full sequence is repeated upon completion of the last sound effects clip.

The sequential sound system may also have a "run on command only" option. When connected to a suitable relay at the push button of the drinking fountain, this option results in a patron activating a sound effects clip when he or she takes a drink from the drinking fountain. Another desirable option is a "message status out" feature. This is a signal to the control system 30, which identifies whether a sound effects clip is playing or not. This signal may then be used by the control system to ignore repeated actuations of the push button by a patron during the time that a sound effects clip is already being played. Manual controls 40 are provided for turning the sequential sound source on and off.

When activated, the background and sequential sound sources 34, 36 transmit electrical signals to a speaker system 42. The speaker system converts the signals into acoustical energy that is audible to nearby patrons. In the preferred embodiment, the speaker system for the background and sequential sound sources includes a compression driver 44 and a woofer 46.

In particular, a signal 48 from the background sound source 34 is split into a first signal 50 and a second signal 52. The first signal 50 passes through a mute circuit 54, a summing amp 56, a high pass filter 58, and a mid-high amplifier 60 before reaching the compression driver 44. The second signal 52 passes through a low pass filter 62 and a bass amplifier 64 before reaching the woofer 46. A signal 66 from the sequential sound source 36 is transmitted to the summing amp 56 where it can be mixed with the first signal 50 from the background sound source 34, then transmitted to the high pass filter 58 and mid-high amplifier 60 before entering the compression driver 44. The amplifiers 60, 64 may be provided with controls 68 to adjust the volume of the sound. The mute circuit 54 permits the first signal 50 from the background sound source to be suppressed, if desired, as will be explained below.

All of the components set forth above are generally available commercially. The mute circuit 54 is preferably a relay or other electrically-controlled switching device. The summing amp 56 is preferably a general purpose audio mixing circuit. A DC power supply (not shown), e.g., +/−15 VDC 100 MA analog power, may be used to power the summing amp. The high pass filter 58 and low pass filter 62 may be general purpose electronic filters sometimes referred to as "tone" controls. The high pass filter may be, for example, approximately 2.4 KHz and the low pass filter may be approximately 3 KHz. The mid-high amplifier 60 and bass amplifier 64 may be general purpose audio amplifiers and may be powered by the VDE-Grade power transformer, referred to above in connection with the audio system 32. Suitable power for the amplifiers would be 25 watts. The compression driver 44 may be a general purpose mid-range or mid-to-high frequency audio compression driver. The woofer 46 may be a general purpose low frequency speaker.

The sound system components may be located in an enclosure (not shown) under the basin of the drinking fountain. This permits ready access to the manual controls of the audio system and to the volume controls of the amplifiers.

In the preferred embodiment, the compression driver 44 is mounted to the drain pipe 24 of the drinking fountain 14 and directs sound into the drain pipe 24. With reference to FIG. 1, an acoustic pipe 70, having a first end 72 and a second end 74, acoustically couples the driver 44 to the drain pipe 24. In particular, the driver is mounted to the first end 72 of the acoustic pipe and the second end 74 of the acoustic pipe is coupled to the drain pipe, providing an unobstructed sound path through the acoustic pipe into the drain pipe. Preferably, the angle of orientation between the acoustic pipe and the drain pipe is such that the driver directs sound waves into a portion 76 of the drain pipe that goes to the basin 20. Thus, when a sound effects clip is played, the sound will emanate from the opening where the basin 20 meets the drain pipe 24. It is also desirable that the acoustic pipe 70 be located above the drain pipe to minimize the amount of water that may come into contact with the driver. Alternatively, a water isolation membrane 75, such as a thin plastic diaphragm, may be fixed in the acoustic pipe to prevent passage of liquid from the drain pipe to the driver. For example, the acoustic pipe may include two pieces, with one piece having the membrane placed over an end of it and then press fit into the other piece.

The acoustic pipe and the drain pipe may be made of metal or plastic. The acoustic pipe may be connected to the drain pipe by a "tee" adapter. The driver may be connected to the acoustic pipe by a conventional threaded pipe connection.

As mentioned above, the control system 30 may be a solid state or relay-based system that controls actuation of the valve and certain operations of the audio system 32. With respect to the valve, the control system sends a valve open command to the solid state relay 28 when a patron depresses the push button on the drinking fountain (FIG. 2). This energizes the solenoid valve. Releasing the push button, deenergizes the valve.

When the patron pushes the button, the control system may also be designed to send a pulse to the sequential sound source 36, causing it to run a sound effects clip. Pressing the push button can also trigger the mute circuit 54, which suppresses the background sound source 34 while a sound effects clip is being played. Alternatively, the control system can be designed to trigger the sequential sound system and mute circuit upon release of the push button or after any desired time delay.

The control system can also be designed to continuously monitor the "message status out" signal of the audio system 32, previously mentioned, to confirm whether or not a sound effects clip is being played. If a sound effects clip is being played, the control system ignores depressions of the button that occur during the clip's playback and continues to mute the background music. If a sound effects clip is not being played, the control system will permit another pulse to be transmitted to the sequential sound source, which starts the next clip in sequence. The design of a control system such as described above is well known to those skilled in the art and need not be described in detail herein.

With reference to FIG. 3, a preferred simplified embodiment of the sound effects system is shown. In this embodiment, the push button 22 closes two contacts, at pole 1 and pole 2. Closure at pole 1 completes a 24 VDC circuit to activate the solenoid valve 26 to supply water to the spout of the fixture. Closure at pole 2 triggers the audio system 106. In this embodiment, the audio system is preferably an electronic solid state analog or digital audio storage/playback unit, such as that sold by the company "360 Systems" under the name "Series 1000." This type of audio system includes a sequential sound source that can run a series of sound effects clips, such as from a tape, disk or EPROM chips. For example, the "Series 1000" audio system accepts eight 4 MEG EPROMS to play sound clips that together last up to three minutes. Each clip may also be provided with a delay such that the audible portion of the sound effects clip will not be heard until a predetermined amount of time has passed after the push button has been pressed. The delay permits water to begin flowing into the drain before the sound effect is played.

In this embodiment, the audio system itself is programmable such that it may be triggered to play one sound clip at a time upon actuation of the push button and to ignore repeated actuations of the push button while a sound clip is playing. This eliminates the necessity of the separate control system 30 shown in FIG. 2. When activated, the sequential sound source transmits an electrical signal to a speaker 108, which converts the signal into acoustical energy that is audible to nearby patrons. As in the embodiment shown in FIG. 2, the speaker may be mounted to the drain pipe of the drinking fountain and directs sound into the drain pipe. The simplified embodiment also omits the background music source, thus eliminating the need for the mute circuit and the summing amp. The low pass filter, bass amplifier and woofer may also be eliminated in this design.

It should be appreciated from the foregoing description that the present invention combines a drinking fountain, faucet or other fixture with a sound effects system. The sound effects may be pre-recorded or pre-produced and played back when a person uses the fixture. Thus, the invention includes an audio playback system that is cued to the use of the fixture. Alternatively, the sound effects system may simply be a speaker connected to any audio source, such as a radio or microphone. A real time synthesis unit may also be used. The invention also concerns the connection of the speaker to the drain pipe such that the sound effects emanate from the drain of the fixture. The present invention is particularly suitable in amusement parks and theme parks, where it is likely to bewilder those who use it for the first time and amuse and entertain those who have tried it before.

Although the invention has been described in detail with reference only to the preferred embodiment, those having ordinary skill in the art will appreciate that various modifications can be made without departing from the invention. Accordingly, the invention is defined with reference to the following claims:

I claim:

1. A fixture that is supplied with a pressurized fluid, the fixture comprising:

a spout for delivering the pressurized fluid;

a human actuatable valve for controlling the delivery of pressurized fluid from the spout;

a drain pipe for receiving fluid drawn from the spout; and an audio system including a speaker wherein the speaker is mounted to the drain pipe in such a manner as to direct sound waves into the drain pipe.

2. The fixture of claim 1, further comprising an acoustic pipe having a first end and a second end, the speaker mounted to the first end of the acoustic pipe and the second end of the acoustic pipe coupled to the drain pipe to provide a sound path into the drain pipe from the speaker.

3. The fixture of claim 2, further comprising a basin mounted at one end of the drain pipe for collecting fluid from the spout and delivering the fluid to the drain pipe, the angle between the drain pipe and the acoustic pipe being such that the sound from the speaker is directed into a portion of the drain pipe that goes to the basin.

4. The fixture of claim 1, wherein the audio system is responsive to actuation of the valve such that it plays an audible sound from the speaker in response to said actuation.

5. The fixture of claim 4, wherein the audio system includes a prepared sound clip that is played in response to actuation of the valve.

6. The fixture of claim 4, wherein the audio system includes a sequential sound source having a plurality of sound clips that are playable in response to respective actuations of the valve.

7. A fixture that is supplied with a pressurized fluid, the fixture comprising:

a spout for delivering the pressurized fluid;

a human actuatable valve for controlling the delivery of pressurized fluid from the spout;

an audio system including a speaker; and means responsive to actuation of the valve for triggering the audio system to play an audible sound from the speaker.

8. The fixture of claim 7, wherein the audio system includes a prepared sound clip that is played in response to actuation of the valve.

9. The fixture of claim 7, wherein the audio system includes a sequential sound source having a plurality of sound clips that are playable in response to respective actuations of the valve.

10. The fixture of claim 9, further comprising a drain pipe for receiving fluid drawn from the spout, wherein the speaker is mounted to the drain pipe and directs sound waves into the drain pipe.

11. The fixture of claim 10, further comprising an acoustic pipe having a first end and a second end, the speaker mounted to the first end of the acoustic pipe and the second end of the acoustic pipe coupled to the drain pipe to provide a sound path into the drain pipe for the speaker.

12. The fixture of claim 7, wherein said means is responsive to each actuation of the valve.

13. The fixture of claim 12, further comprising means for ignoring triggering of the audio system when audible sound is being played from the speaker.

14. The fixture of claim 7, wherein human intervention is required for each actuation of the valve.

15. The fixture of claim 14, wherein said means is responsive to each actuatio of the valve.

16. The fixture of claim 15, further comprising means for ignoring triggering of the audio system when audible sound is being played from the speaker.

17. The fixture of claim 7, wherein the fixture is a drinking fountain.

18. The fixture of claim 17, wherein said means is responsive to each actuation of the valve.

19. The fixture of claim 18, further comprising means for ignoring triggering of the audio system when audible sound is being played from the speaker.

20. A drinking fountain that is supplied with water, the drinking fountain comprising:

a spout for delivering the water;

a human actuatable valve for controlling the delivery of water from the spout;

a basin for collecting water from the spout;

a drain pipe for receiving water collected in the basin; and an audio system including a speaker and a sequential sound source having a plurality of sound clips;

wherein the speaker is mounted to the drain pipe in such a manner as to direct sound waves into the drain pipe; and wherein the audio system is responsive to actuation of the valve such that the plurality of sound clips are playable in response to respective actuations of the valve.

* * * * *